US008713857B2

(12) United States Patent
Logue

(10) Patent No.: US 8,713,857 B2
(45) Date of Patent: May 6, 2014

(54) MODULAR PANEL SYSTEM

(75) Inventor: Michael Logue, San Francisco, CA (US)

(73) Assignee: Michael Logue, San Francisco, CA (US)

( * ) Notice: Subject to any disclaimer, the term of this patent is extended or adjusted under 35 U.S.C. 154(b) by 308 days.

(21) Appl. No.: 12/616,121

(22) Filed: Nov. 10, 2009

(65) Prior Publication Data

US 2010/0132895 A1 Jun. 3, 2010

Related U.S. Application Data

(60) Provisional application No. 61/200,731, filed on Dec. 3, 2008.

(51) Int. Cl.
*E04B 2/74* (2006.01)

(52) U.S. Cl.
USPC ..... 52/36.6; 52/36.5; 52/29; 312/246; 312/248; 160/200; 160/210

(58) Field of Classification Search
USPC ..... 52/207, 70, 71, 238.1, 239, 32, 29, 52/36.6, 741.1, 36.1, 36.5; 160/199, 206, 160/193, 200; 312/200, 242, 244, 245, 246, 312/248, 210
See application file for complete search history.

(56) References Cited

U.S. PATENT DOCUMENTS 1,078,502 A * 11/1913 Herrmann ..... 359/854
1,980,730 A * 11/1934 Matchette ..... 312/200
2,200,934 A * 5/1940 Platt et al. ..... 52/32
3,391,796 A * 7/1968 Cross ..... 211/169
3,468,039 A * 9/1969 Dubbert ..... 434/429
3,827,183 A * 8/1974 Zimmerman et al. ..... 49/383
3,888,046 A * 6/1975 Meisterheim ..... 49/319
3,997,220 A * 12/1976 Mayer ..... 312/242
4,068,433 A * 1/1978 Glover ..... 52/207
4,076,350 A * 2/1978 Crist ..... 312/242
4,123,879 A * 11/1978 Blodee et al. ..... 52/36.6
4,367,000 A * 1/1983 Sparks et al. ..... 312/107
4,691,474 A * 9/1987 Rokicki ..... 49/220
4,876,835 A * 10/1989 Kelley et al. ..... 52/239
4,972,634 A * 11/1990 Dresden ..... 52/69
4,986,330 A * 1/1991 McGonagle ..... 160/135
5,042,656 A * 8/1991 Kahre ..... 206/321
5,103,593 A * 4/1992 McNaughton ..... 49/460
5,142,833 A * 9/1992 Svehaug ..... 52/71
5,355,624 A * 10/1994 Bacon ..... 49/280
5,379,552 A * 1/1995 Smith ..... 49/460
5,647,172 A * 7/1997 Rokicki ..... 49/504
5,694,881 A * 12/1997 Creech ..... 116/222
5,775,034 A * 7/1998 Logue ..... 52/36.1
5,845,439 A * 12/1998 Hendley ..... 52/204.1
5,983,570 A * 11/1999 Brown ..... 49/475.1
6,116,326 A * 9/2000 Domina et al. ..... 160/351
6,233,888 B1 * 5/2001 Wu ..... 52/207
6,253,509 B1 * 7/2001 Hellwig et al. ..... 52/239
6,283,429 B1 * 9/2001 Markovich et al. ..... 248/286.1
6,296,038 B1 * 10/2001 Chen ..... 160/199

(Continued)

*Primary Examiner* — Chi Q Nguyen
(74) *Attorney, Agent, or Firm* — Colin Fowler

(57) ABSTRACT

A device is disclosed that replaces an existing panel or door with a reconfigurable modular panel. The invented panel additionally may function as a working door or screen, serving to more optimally employ a room volume. The invented panel can be configured to fit various styles of door frames thus being adaptable to various entry or floor space pattern situations. The invented panel may be electrified allowing modular plug-ins to house a wide array of elements.

15 Claims, 22 Drawing Sheets

(56) References Cited

U.S. PATENT DOCUMENTS

| | | | | |
|---|---|---|---|---|
| 6,347,020 | B1 * | 2/2002 | Carpenter et al. | 360/92.1 |
| 6,381,910 | B1 * | 5/2002 | Katz | 52/211 |
| 6,415,565 | B1 * | 7/2002 | Sosa | 52/207 |
| 6,433,710 | B1 * | 8/2002 | Heavens et al. | 341/107 |
| 6,452,781 | B1 * | 9/2002 | Ahiko et al. | 361/321.2 |
| 6,460,556 | B2 * | 10/2002 | Zheng | 135/125 |
| 6,463,701 | B1 * | 10/2002 | Baloga et al. | 52/29 |
| 6,470,952 | B1 * | 10/2002 | Cline et al. | 160/188 |
| 6,595,017 | B1 * | 7/2003 | Teahan | 62/259.1 |
| 6,703,102 | B1 * | 3/2004 | Prescott | 428/76 |
| 6,931,795 | B1 * | 8/2005 | Baloga et al. | 52/36.1 |
| 6,961,246 | B2 * | 11/2005 | Dickey et al. | 361/724 |
| 7,140,154 | B2 * | 11/2006 | Governale et al. | 52/207 |
| 7,165,649 | B2 * | 1/2007 | Latimer et al. | 182/77 |
| 7,363,879 | B2 * | 4/2008 | Bonner et al. | 119/417 |

* cited by examiner

MODULAR PANEL SYSTEM

This application claims priority under 35 U.S.C. 119(e) to U.S. provisional patent application No. 61/200,731, entitled "Modular Panel System", Inventor: Michael Logue. Filed Dec. 3, 2008.

BACKGROUND OF THE INVENTION

1. Field of the Invention

The present invention relates generally to workspace and domestic spatial organization. The present invention more particularly relates to dual or multi-functional wall, panel and door designs.

2. Description of the Background Art

The prior art and related art includes panel systems with specified uses and stowaway elements. These prior art designs fail to offer a full range of modularity to enable the reconfiguration of a wall, door or panel to offer dual or multifunctional utilities to optimally meet the changing desires of building inhabitants, occupants, workers or visitors.

There is therefore a long felt need to provide a panel system that includes modular components and enables configuration and reconfiguration of the door or separation panel to better address the desires of building inhabitants, occupants, workers and/or visitors.

Additional objects and advantages of the present invention will be set forth in the description that follows, and in part will be obvious from the description, or may be learned by practice of the present invention.

SUMMARY OF THE INVENTION

Towards this object and other objects that will be made obvious in light of this disclosure, a first preferred configuration of the present invention includes a central panel frame which can be adapted to various configurations by attaching outlying variable end rails and a base plate and caster options. Various configurations of the invented panel include a door or panel usable (1.) in a hinged enabled state, (2.) in a sliding enabled state, (3.) in a folding (or "accordion") enabled state, and/or (4.) in a free standing state, 5) wall mounted state and 6) fixed.

The invented panel may include a frame into which variable modular storage and utility components can be installed to fit a variety of different intentions, situations and rooms. The components' functionality will often relate to the space the panel is used.

The invented panel may be configured as, or as an element within, a door or window.

The foregoing and other objects, features and advantages will be apparent from the following description of the preferred aspects of the invention as illustrated in the accompanying drawings.

INCORPORATION BY REFERENCE

All publications, patents, and patent applications mentioned in this specification are herein incorporated by reference in their entirety and for all purposes to the same extent as if each individual publication, patent, or patent application was specifically and individually indicated to be incorporated by reference. U.S. Pat. No. 5,775,034 entitled, "Folding Screen environment System"; U.S. Pat. No. 3,748,010 entitled, "Work Station with Self-Storing Desk"; U.S. Pat. No. 4,131,203 entitled "Wall Mounted Modular Units"; U.S. Pat. No. 3,822,925 entitled, "Utility-Door Storage Container"; and U.S. Pat. No. 5,163,745 entitled, "Door Closet" are incorporated herein by reference entirety and for all purposes.

BRIEF DESCRIPTION OF THE DRAWINGS

These, and further features of the invention, may be better understood with reference to the accompanying specification and drawings depicting preferred configurations, in which.

DETAILED DESCRIPTION

In describing aspects of the invention, certain terminology will be utilized for the sake of clarity. Such terminology is intended to encompass the recited example, as well as all technical equivalents, which operate in a similar manner for a similar purpose to achieve a similar result.

It is to be understood that this invention is not limited to particular aspects of the present invention described, as such may, of course, vary. It is also to be understood that the terminology used herein is for the purpose of describing particular aspects only, and is not intended to be limiting, since the scope of the present invention will be limited only by the appended claims.

Methods recited herein may be carried out in any order of the recited events which is logically possible, as well as the recited order of events.

Where a range of values is provided herein, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the methods and materials are now described.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

For purposes of this disclosure the term, obstruction element, refers to an object in which by the presence of said object prevents a human eye from viewing behind the object's surface area. Further the term, a construction, shall for the purposes of this disclosure be defined as a man-made object. Examples of a construction include a building, a watercraft, an aircraft, a submarine, and a spacecraft.

Figure 1:
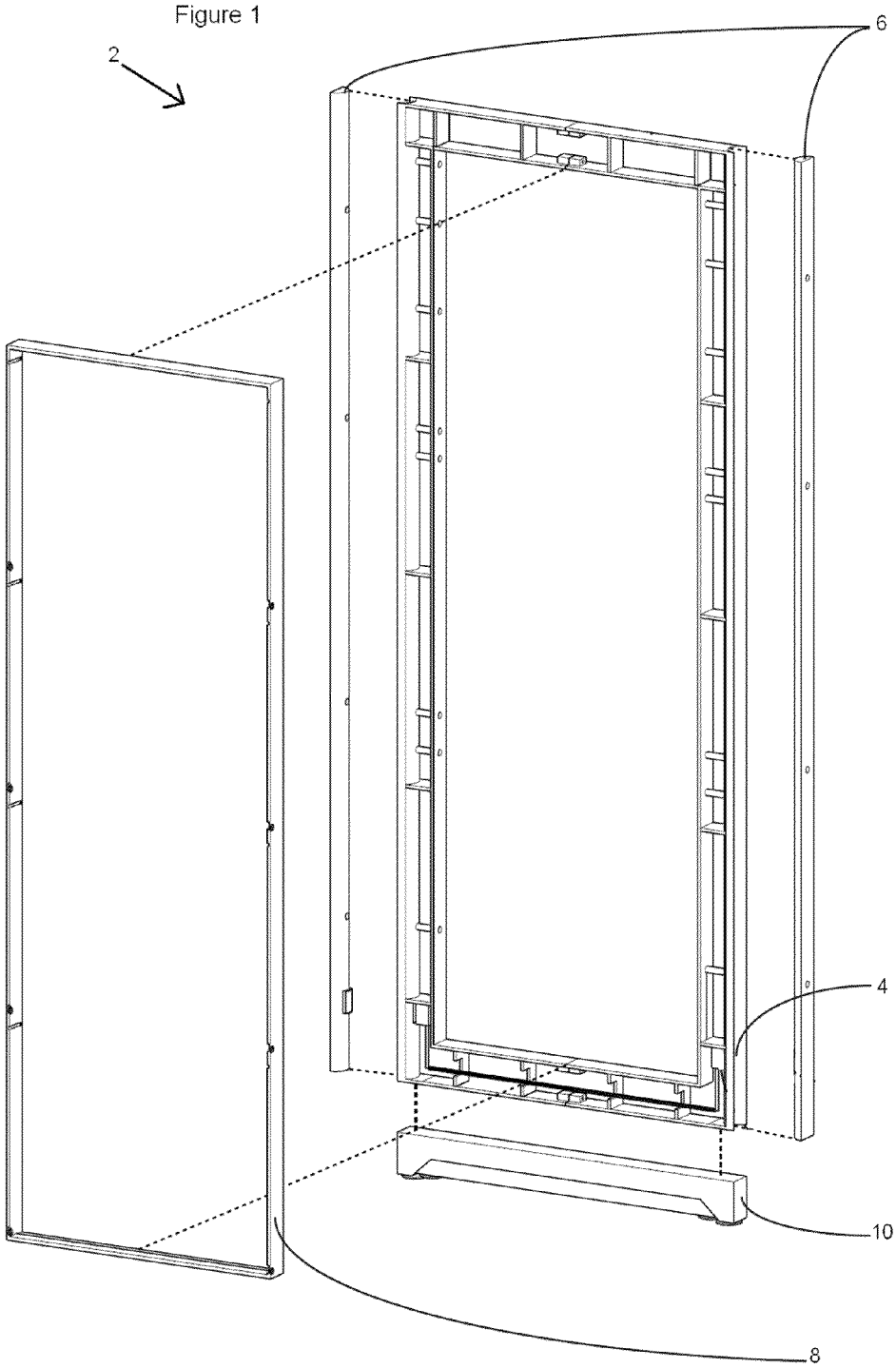
FIG. 1 is an exploded view of the panel structure and its various attachments.
Figure 13:
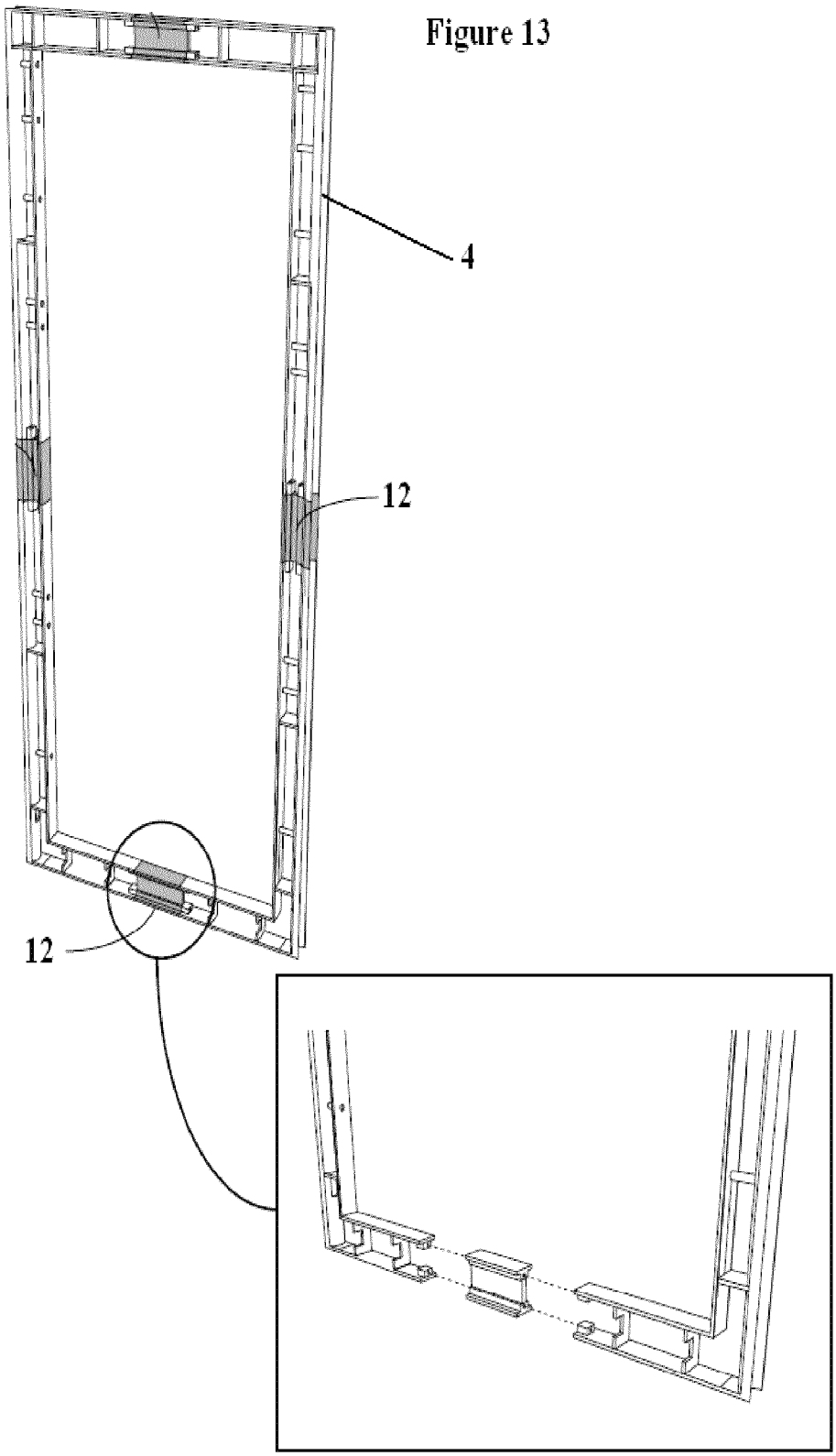
FIG. 13 is an assembled view of the panel frame with additional vertical and horizontal spacers to adapt the frame to multiple size situations.

Referring now generally to the Figures and particularly to FIG. 1 and FIG. 13, FIG. 1 is an exploded view of a panel structure 2 and various attachments while FIG. 13 is an assembled view of a panel frame 4 with additional spacers 12 to adapt the panel frame 4 to multiple size configurations as required to provide a structure to meet a door, window or divider function. The door panel structure 2 is composed of a panel frame 4 which fills the portion of the door panel commonly known as the architrave, two variable end rails 6, a primary bracket attachment 8, and an optional base plate attachment 10. The invented panel 3 includes modular storage components 16 and an interchangeable skin 18 which will both be discussed in more detail later. The panel frame 4 with a variable base plate 10 attached to its base may match the size and form specifications of the smallest of the standard of international and American doors sizes, e.g., a thirty inches by eighty inches cross-section. These size specifications can be modified by the addition of vertical and horizontal spacers 12 in appropriate vertical sections and horizontal sections for extenders and thus can accommodate other commonly standardized door frames or custom door requirements. The variable end rails 6 serve to define what the panel 3 will fasten to, and may allow the panel 3 to fit into various entry, window or separator situations. The variable base plate and floor caster 10 additionally serves to allow the panel 3 to fit into multiple situations that a door, window, or panel might require.

Figure 2:
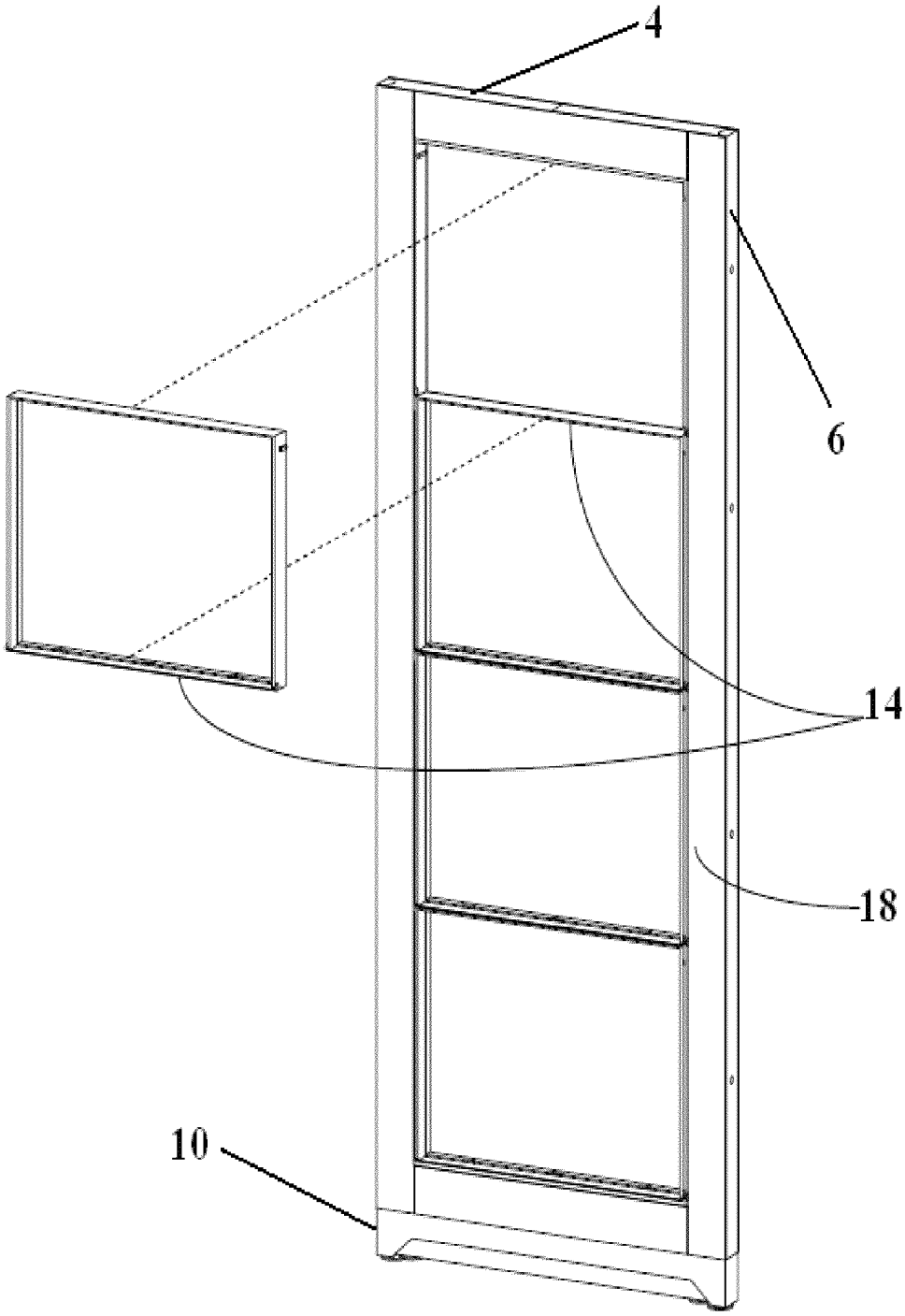
FIG. 2 is an assembled view of the panel structure with its secondary attachment brackets.

Referring now generally to the Figures and particularly to FIG. 2; FIG. 2 is an assembled view of the panel structure 2 with its secondary attachment brackets 14; When assembled the panel structure 2 will include at least one secondary bracket attachment 14 for allowing the attachment of modular storage and utility elements 16. These secondary attachment brackets 14 fasten to the primary attachment bracket 8 and allow for variable positioning of modular elements 16. These secondary brackets 14 can be any size that fits inside the frame 4 and any number can be used. The panel frame 4 is then sheathed with an interchangeable skin 18 made of wood veneer and/or metal panels, plastic panels, flame retardant material, or any other finish known in the art.

Figure 14:
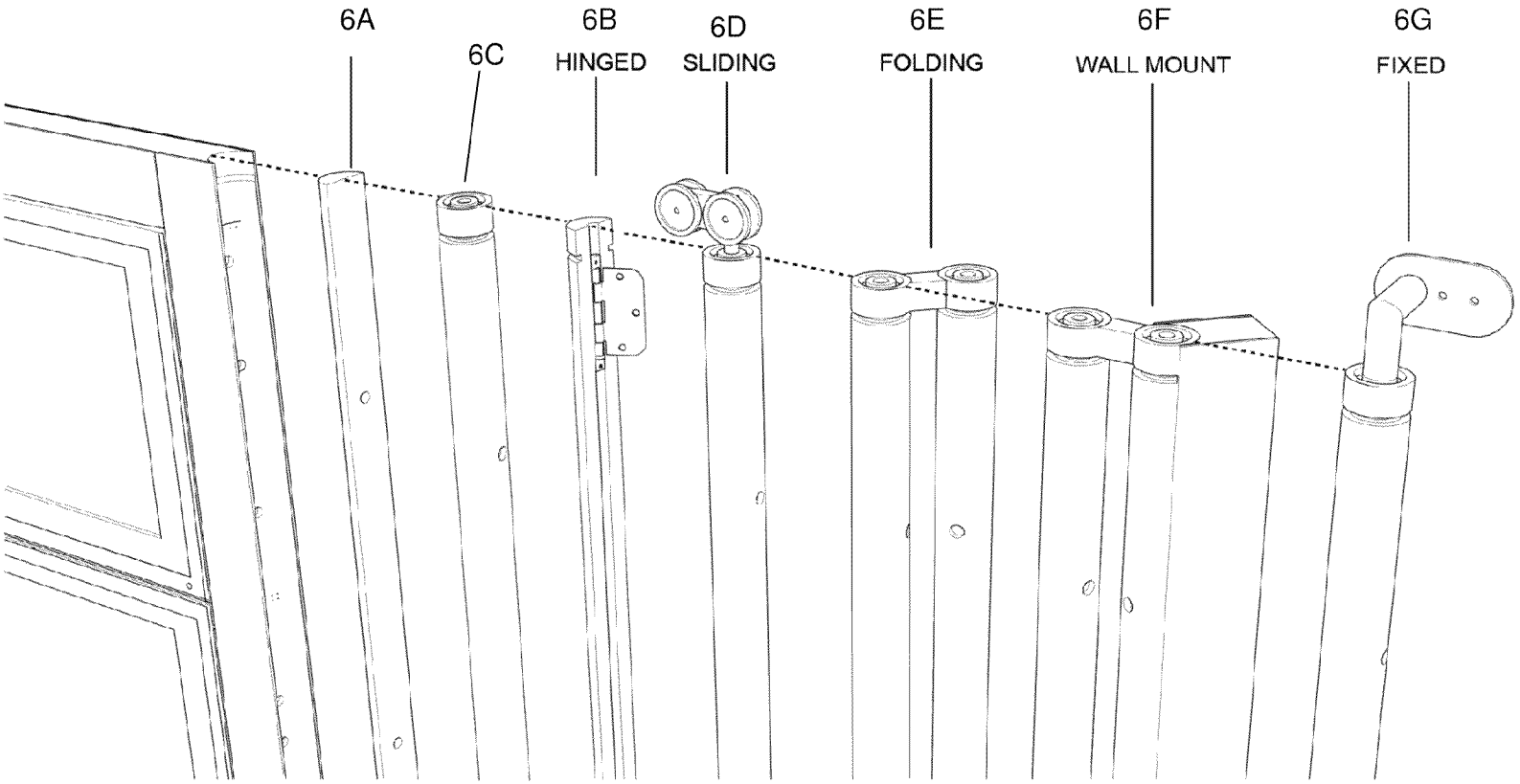
FIG. 14 is an exploded side view of the invented door panel with examples of variable end rail options.
Figure 15:
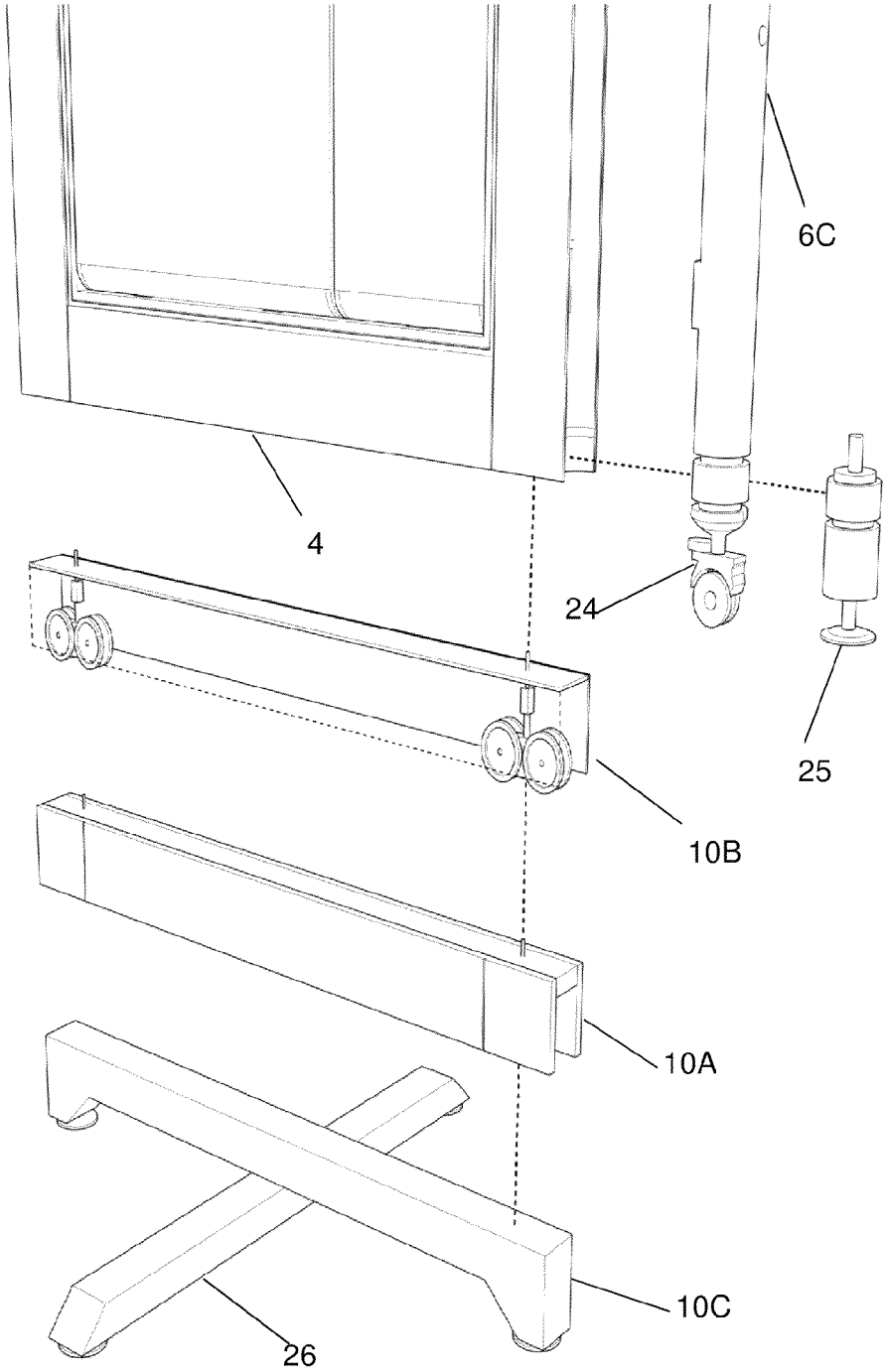
FIG. 15 is an exploded side view of the invented door panel with examples of variable base plate and caster options.

Referring now generally to the Figures and particularly to FIGS. 14 and 15; FIG. 14 is an exploded side view of the panel 3 with some possible variable end rail options 6A-G, while FIG. 15 is an exploded side view of the invented panel 3 with some possible variable floor base plate and caster options 10A-C and the lower segment of one end rail option 6C. The variable end rails 6 serve to connect the invented panel 3 to a multitude of common door or separator configurations and could be adapted to fit more uncommon situations. The variable end rails 6 in conjunction with the variable floor casters 10 serve to create multiple preferred configurations of the presently invented panel 3. The options depicted in FIG. 14 are not intended to be limiting and are shown only to serve as possible variations 6A-G on the end rail design 6 for the panel 3. Such options could consist of: a place holder end rail 6A to serve as a filler or to be used in cases where at least one side of the panel 3 might not be required to attach to anything, a hinged end rail 6B to serve in a classic door frame, an end rail with a base mounted swivel wheel 6C for mobile panel situations, a track wheel end rail 6D for sliding door configurations, a daisy-chain end rail pair 6E for connecting two adjoining door panels 3, a daisy-chain end rail wall mount 6F for a wall fastened but adjustable door panel, and/or a fixed wall mount end rail attachment 6G for a wall fastened in a fixed position configuration panel. In conjunction with the variable end rails 6, a variable floor caster 10 additionally serves to adapt a panel 3 to better address the desires of various sites and users. The floor caster options 10A-C depicted in FIG. 15 are not intended to be limiting and are shown only to serve as possible variations 10A-C on the floor base plate design 10 for the invented panel 3. Such options might include: a place holder floor base plate 10A to serve as a space filler spanning the gap between the panel frame 4 and the floor, a track wheel floor caster 10B would serve to align a sliding door configuration, and/or a lockable, rotating floor base 10C to serve as a support mechanism for free standing door panels.

Figure 3:
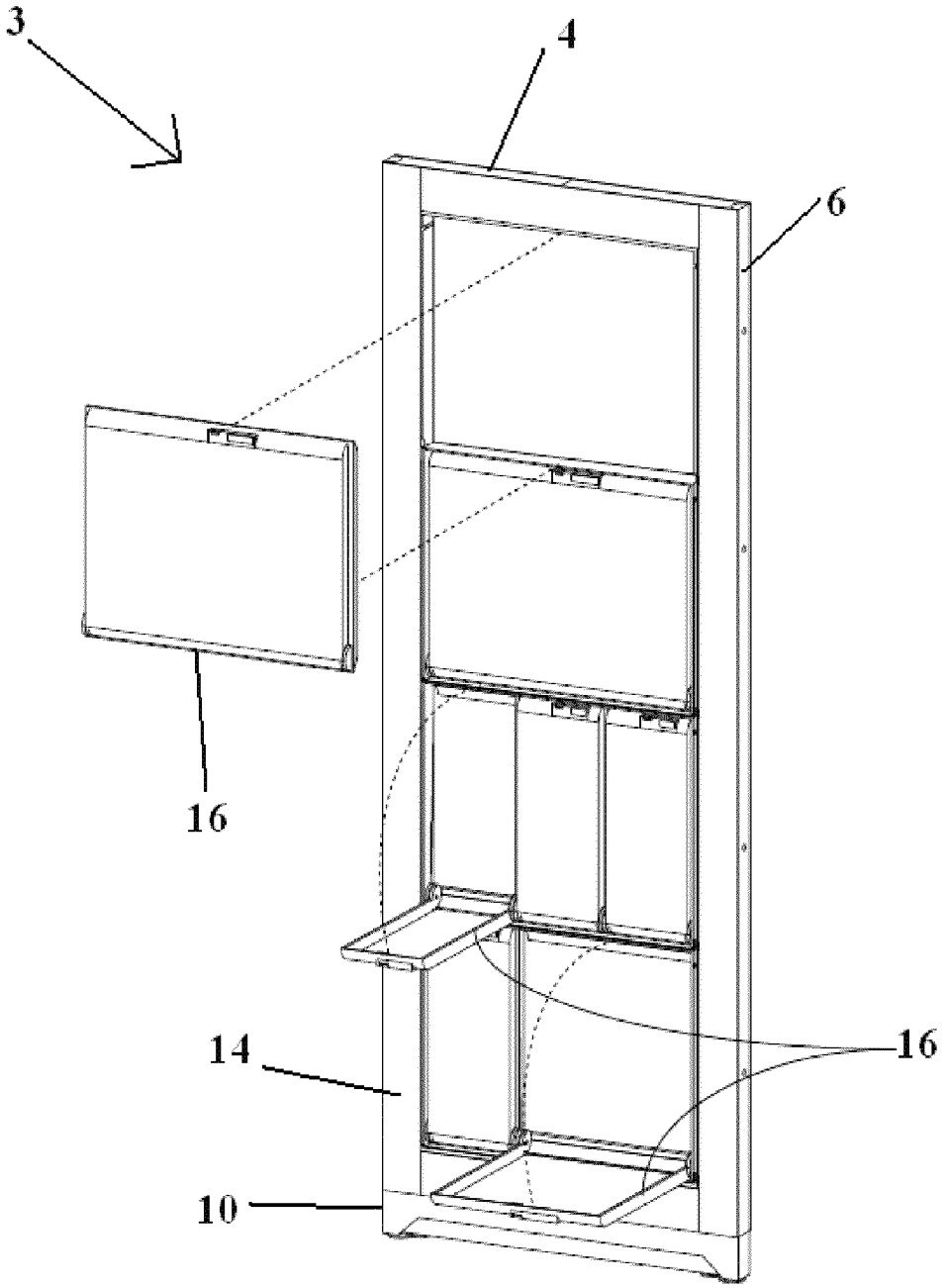
FIG. 3 is a side view of the invented door panel with modular storage components installed.

Referring now generally to the Figures and particularly to FIG. 3, FIG. 3 is a side view of the panel 3 with modular storage components 16 installed. These modular storage components fit into the secondary attachment brackets. Most commonly these components will match flush with the door panel's frame 4 measuring between one to three inches thick, but in certain situations such as the inside of a closet door, will be able to protrude outward or inward and be significantly larger, within the range of three inches to twelve inches or greater. The modular elemtents 16 can be adapted to fit many different room environments, and can accommodate certain object(s) that fit within the thickness of the panel 3. The modular components 16 may be designed to take advantage of thin profile technology devices in order to adapt to a greater variance in room environments and allow for the storage of a greater variety of items.

Figure 12:
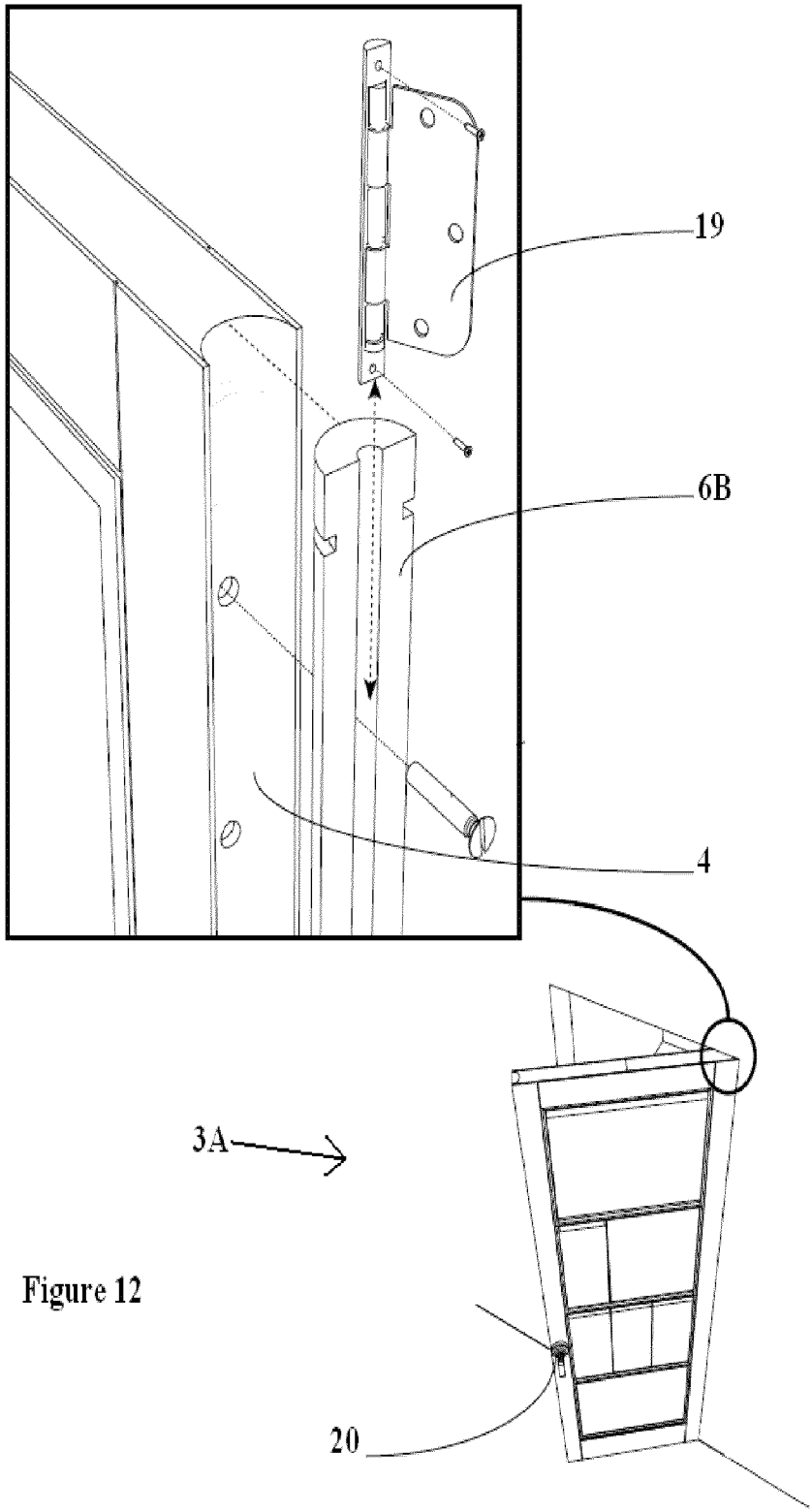
FIG. 12 is a close up view of the hinged door end rail attached to a single invented panel and installed in a doorway.

Referring now generally to the Figures and particularly to FIG. 12, FIG. 12 is a close up view of the hinged door end rail 6B attached to a single panel 3 and installed in a doorway. Use of the hinged door end rail 6B in the panel 3 is a first configuration 3A of the various applications that can be assembled in order to allow for specific or generalized doorway conditions and user desires. In this first configuration 3A the end rail 6B has a hinge 19 screwed in on the top and bottom to allow the panel 3 to be mounted to a standard door frame. Associated with this first configuration 3A is a place holder floor base plate 10A that may serve a function of covering a distance from the bottom of the panel 3 to meet flush with the floor so as to form a solid door. Finally in this first configuration 3A door hardware and a handle 20 could optionally be mounted into the frame 4 of the panel 3.

Figure 11:
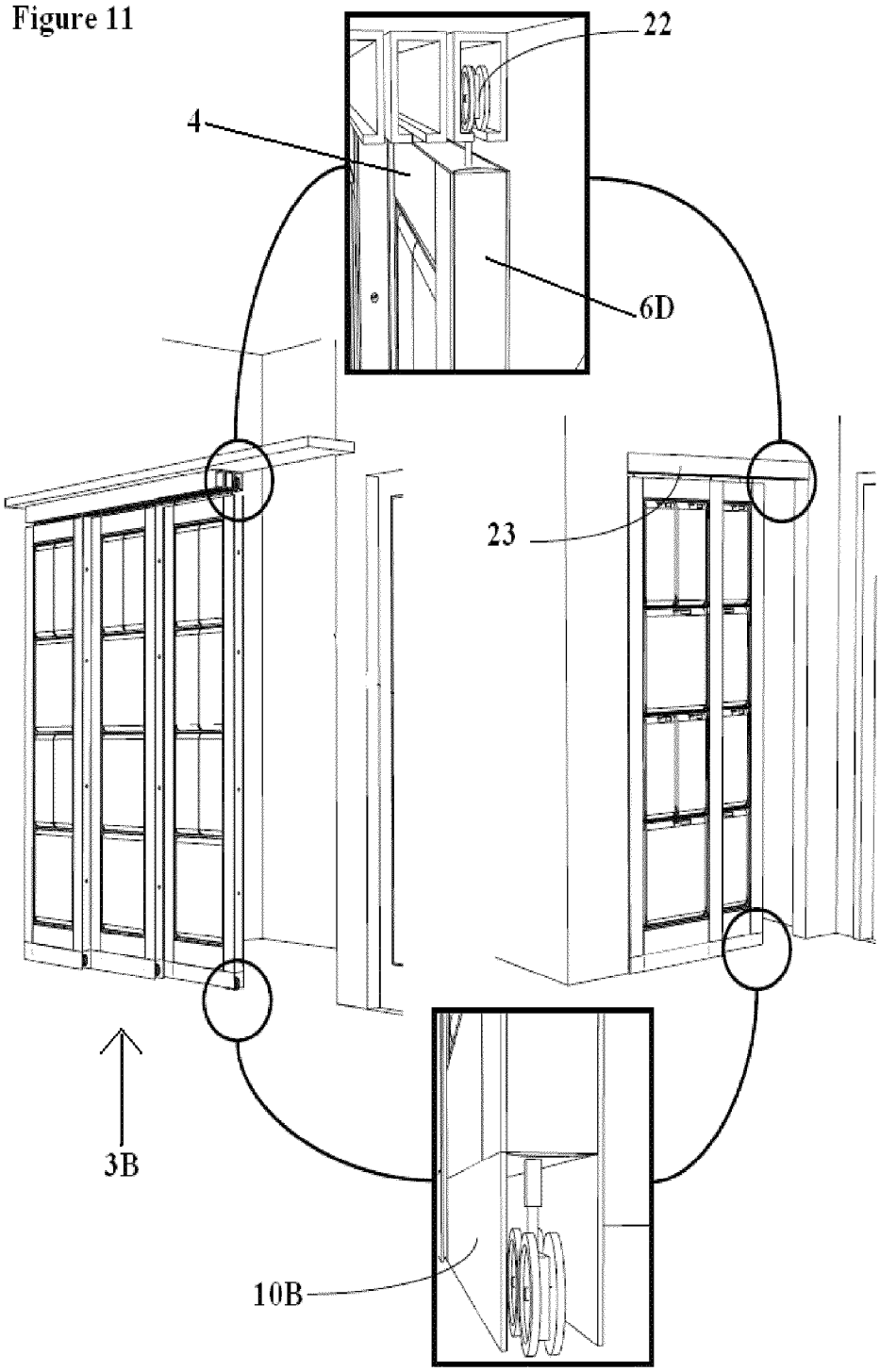
FIG. 11 is a multi-view of several invented panels in a sliding door configuration.

Referring now generally to the Figures and particularly to FIG. 11, FIG. 11 is a multi-view of several door panels 3 in a sliding door configuration. The sliding door configuration displays a second configuration 3B of the panel 3 using a track wheel variable end rail 6D which would be bolted on to the panel frame 4. To the top and bottom of this variable end rail 6D a set of track wheels 22 will be affixed in order to allow the panel 3 to slide freely in a standard door track 23. Additionally associated with this second configuration 3B of the panel 3 will be a track wheel floor caster 10B in which a series of track wheels 22 would be encased for additional stability. In this configuration 3B any number of door panels 3 may be affixed to the standard sliding door track 23 as may be needed.

Figure 7:
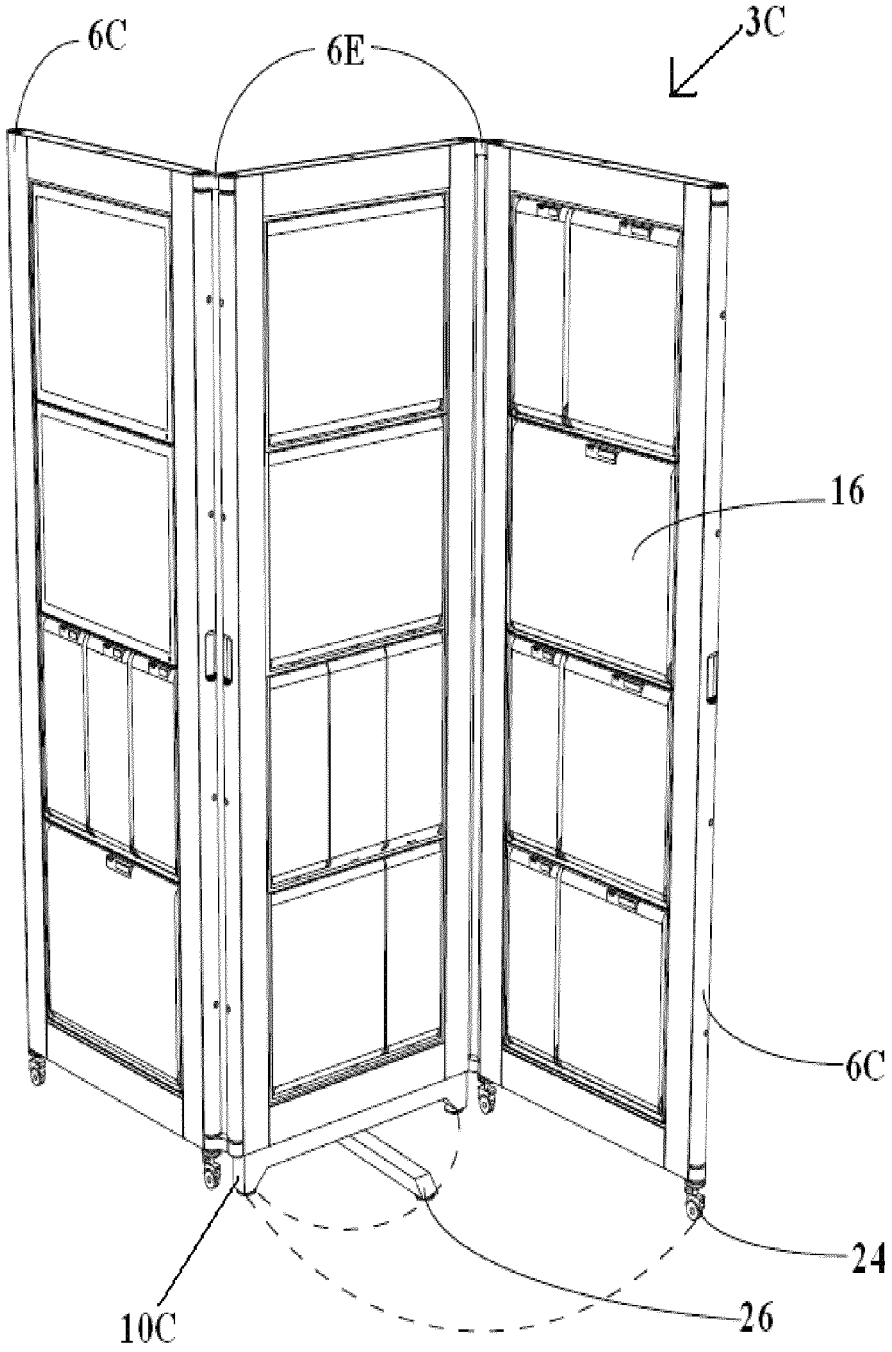
FIG. 7 is a side view of a free-standing usage of three invented panels with modular plug-ins, daisy-chained together, e with a rotating floor caster for stability.
Figure 8:
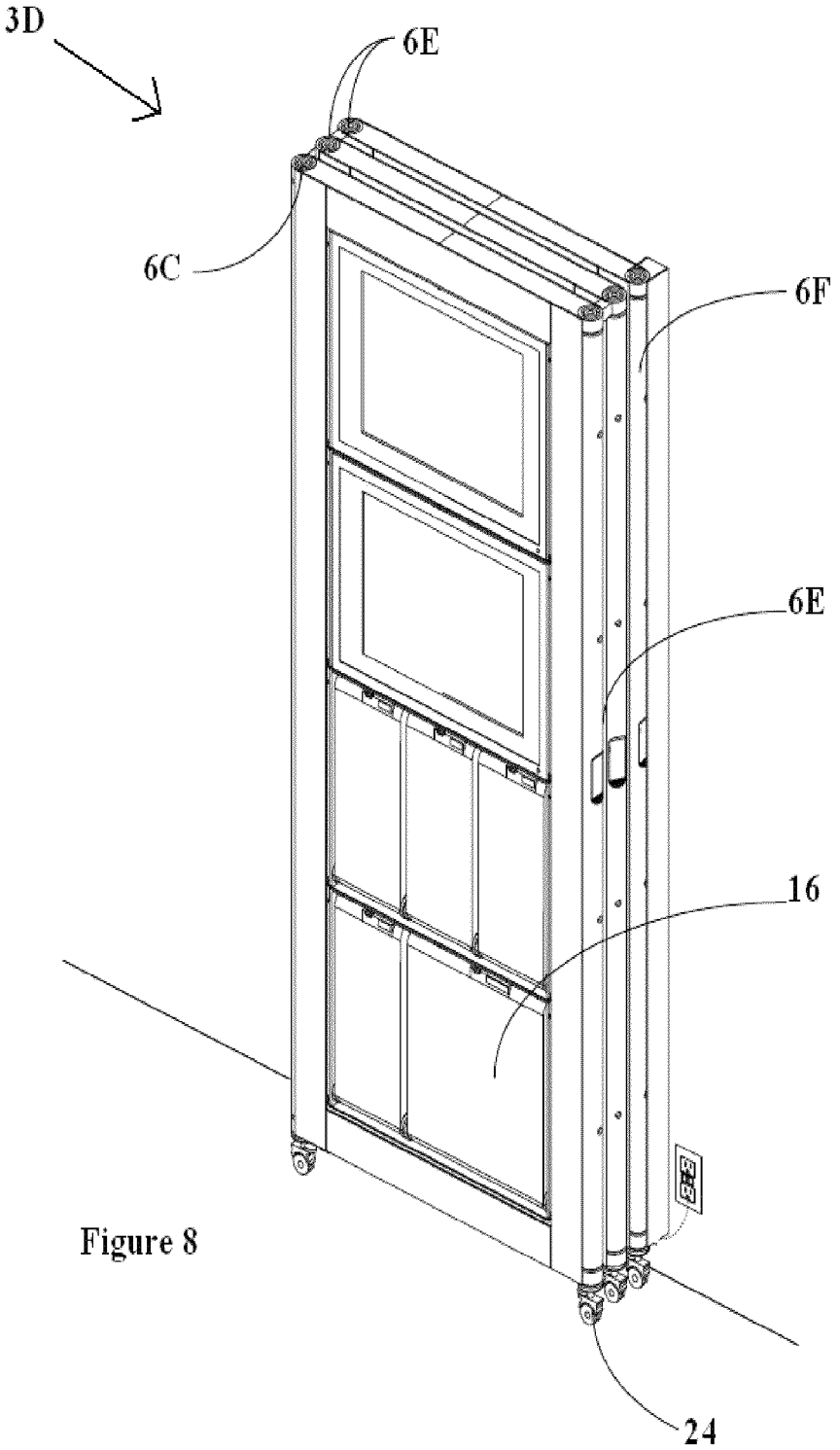
FIG. 8 is a side view of the assembly of invented panels of FIG. 7 in a stored configuration and secured to a wall and showing a possible source of power for electrified components.
Figure 9:
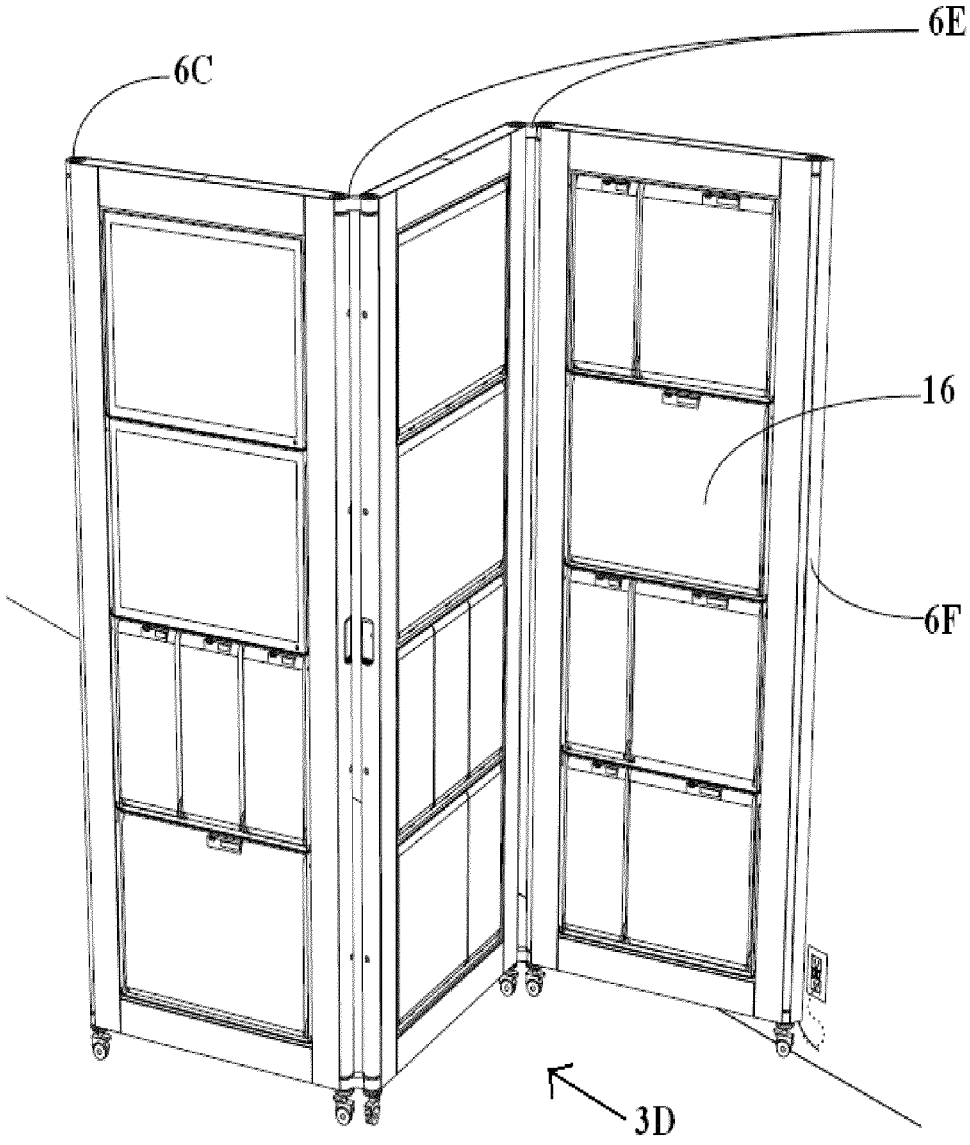
FIG. 9 is an open view of the wall secured assembly of invented panels of FIGS. 7 and 8
Figure 10:
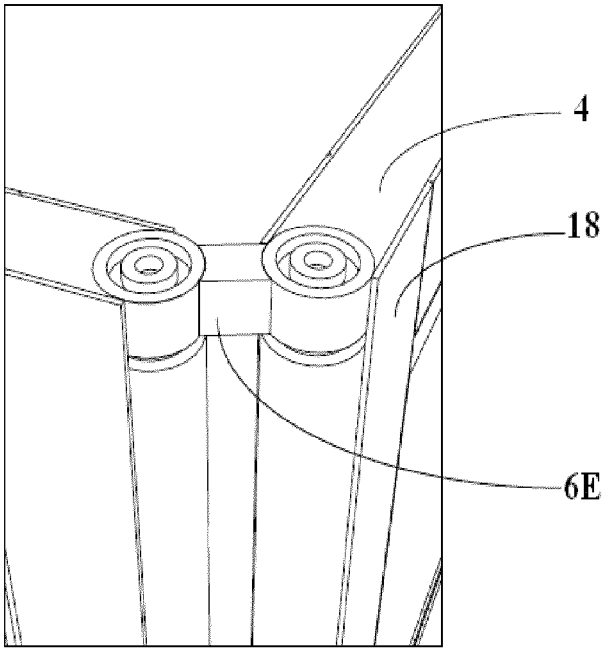
FIG. 10 is a close up view of the daisy-chained end-rail attaching to two separate invented panels.
Figure 10:
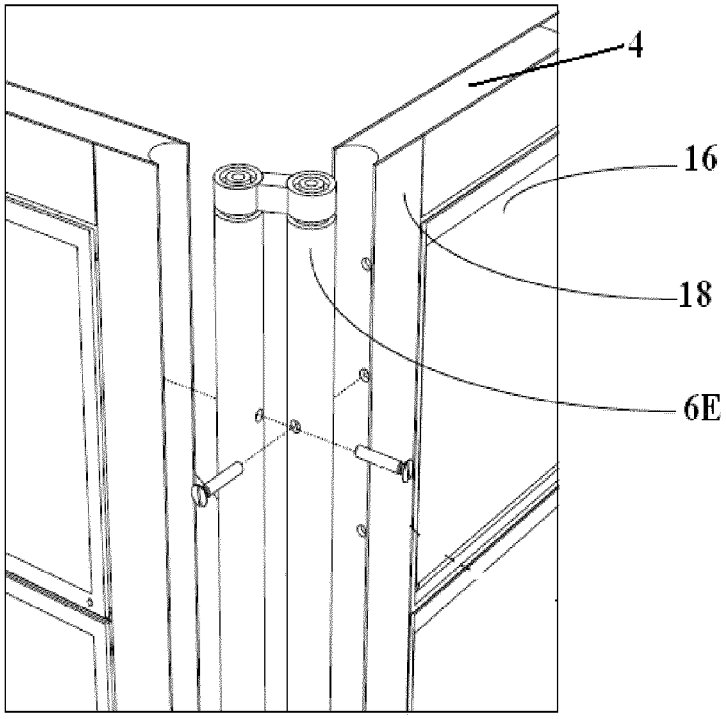

Referring now generally to the Figures and particularly to FIGS. 7, and FIG. 10, FIG. 7 is a side view of three invented panels 3 with modular plug-ins 16 daisy-chained together, using a rotating floor base 10C for stability, FIG. 10 is a close up of the daisy-chain end-rail 6E attached to two separate door panels 3. Use of the daisy-chain end rail 6E in conjunction with the panel frame 4 is a third configuration 3C of the invented panel 3. This particular choice of variable end rail 6E allows two or more invented door panels to be linked together and swing freely about each other. Additionally this choice of end rail 6E has a lockable, swivel wheel 24 affixed to its base for easy movement and positioning. On the ends of the linked panels 3 a swivel wheel end rail 6C is utilized to allow ease of movement. Associated with this third configuration is a rotating floor base plate 10C which may be optionally placed on the base of any number of the door panels 3. This rotating floor base plate 10C covers the distance from the base of the panel to the floor and has a rotating bar 26 that can spin out orthogonally to allow a free-standing condition as well as provide additional support to the panel series Referring now generally to the Figures and particularly to FIGS. 8, and FIG. 9, FIG. 8 is a compressed view of the assembly of invented panels 3 of FIG. 9, secured to a wall with a wall mount end rail 6F and FIG. 9 is an expanded view of the same assembly of wall mounted daisy-chained panels 3 of FIG. 8. Use of the wall mount end rail 6F in conjunction with the panel frame 4 is a fourth configuration 3D of the invented panel 3. This configuration 3D consists of two rails daisey-chained together 6E much like the third configuration 3C with the alteration on one or more sides having the ability to affix to a wall.

Figure 16:
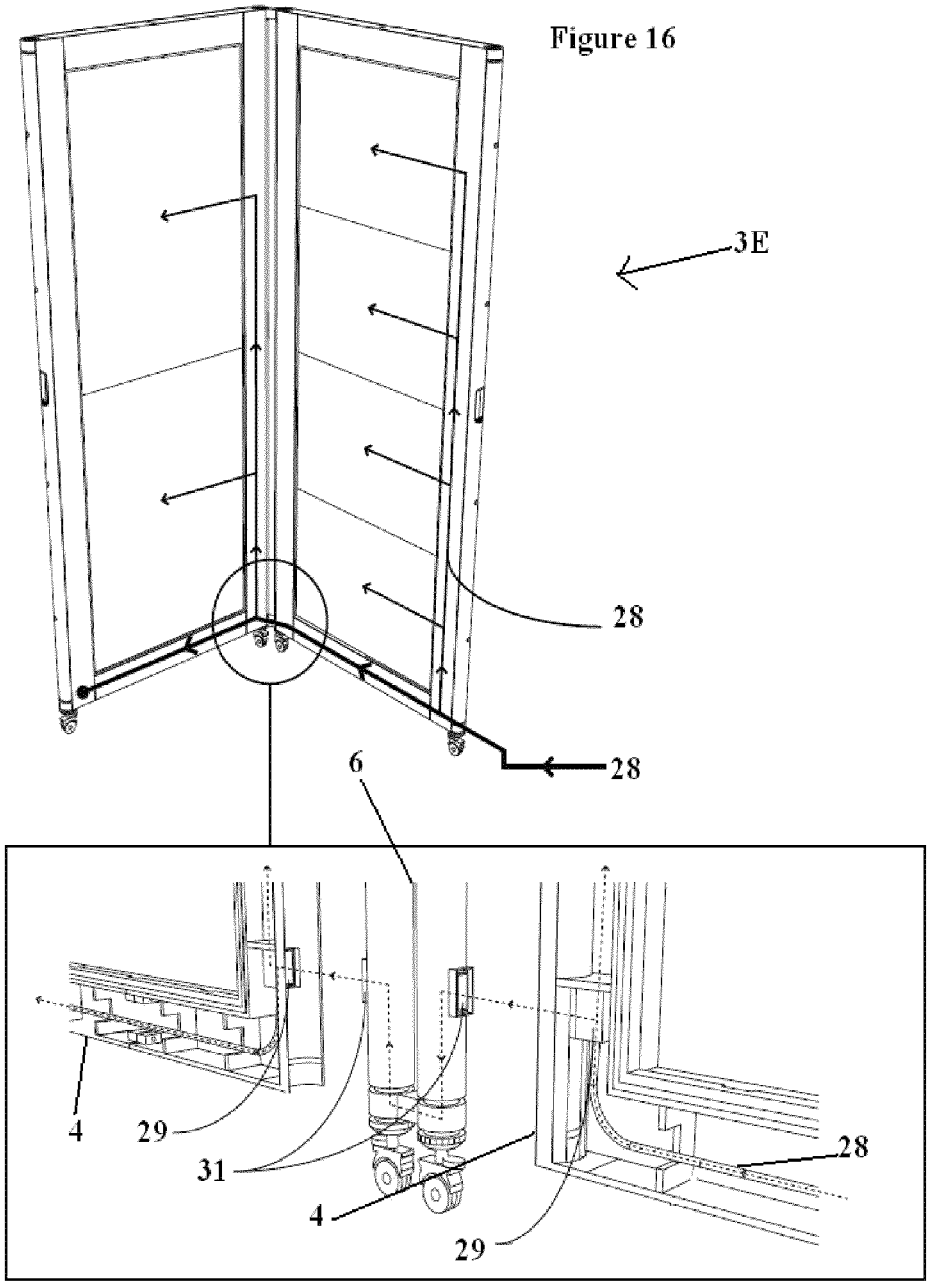
FIG. 16 is a cut away view of two invented door panels daisy-chained together with included electrical wiring within the framework to power the panel(s)

Referring now generally to the Figures and particularly to FIG. 16, FIG. 16 is a cut away view of two door panels 3 daisy-chained together with included electrical wiring 28 within the framework to power the panel 3. Electrifying the invented door panel may be enabled by an additional fifth preferred configuration 3E that can be optionally combined with certain variations of the previously disclosed configurations 3A-D. The panel 3 may optionally include electrical wiring 28 that may enter the invented panel through a small hole in the base of the frame 29 and then run throughout the panel's frame 4 in order to power certain items such as flat screen monitors 30, lighting elements 32, computer components 34, or any other powered element that could be incorporated into the modular storage components 16. Electrical wiring 28 can span more than one invented panel by being worked through a variable end rail 6 through small channels at their base 31.

Such computer components 34 would not have to be limited to peripherals and could consist of entire computers. Computers such as a 2009 version of an Apple iMac 20" will fit into non-flush modular elements 16A-B (shown in FIGS. 18-20), but with some minor changes would easily fit into flush modular elements 16 of the invented panel 3E. With minor adjustments to other similar computer's designs, a full computer could be easily incorporated as a powered object within one or more modular plug-in elements 16. Flat screen monitors 30 such as TV's may be configured to fit entirely within the invented panel 3E with little to no modification. Among other suitable examples, such TV's would include the Sony XEL-1 OLED flat screen.

Figure 4:
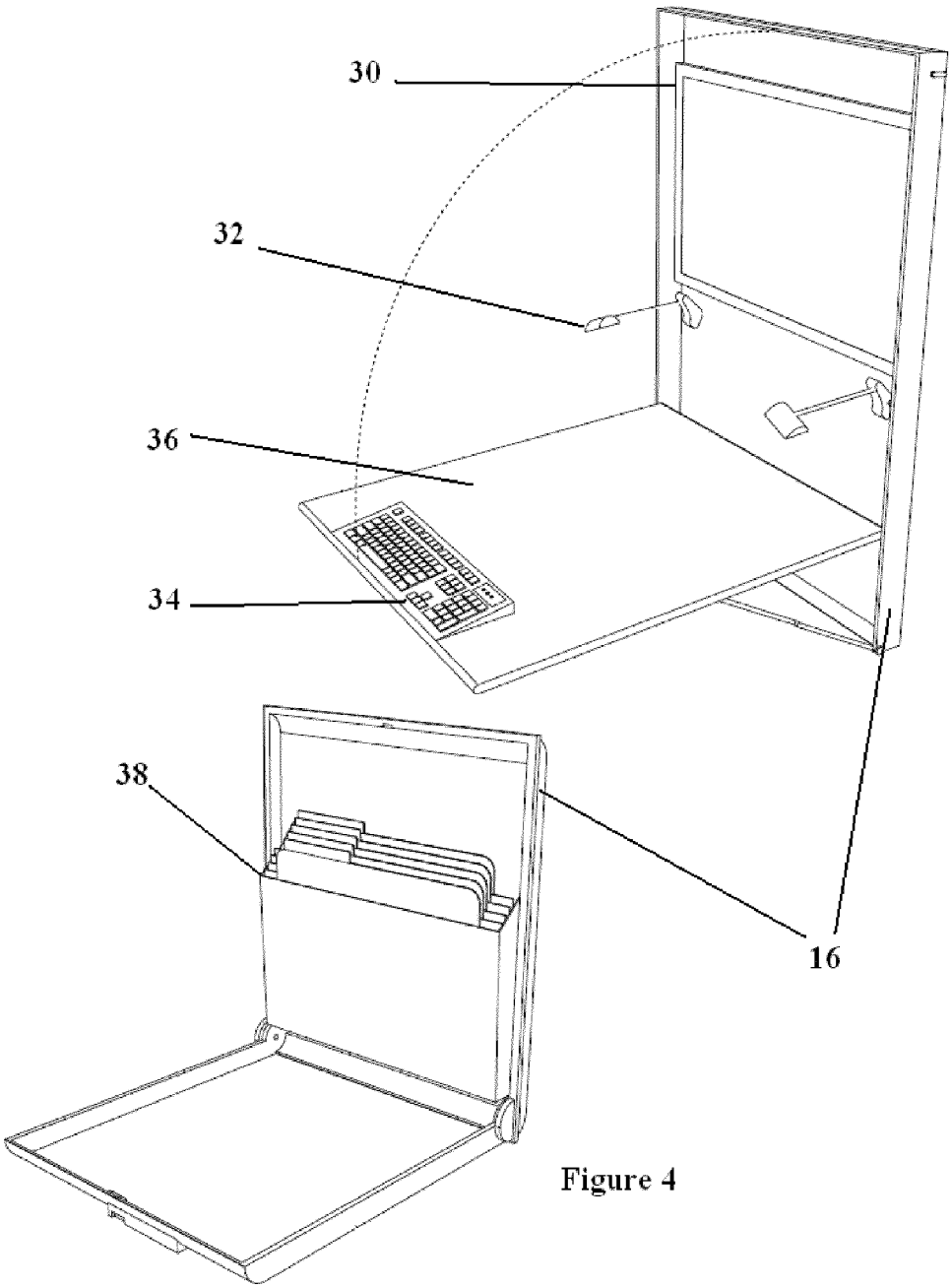
FIG. 4 is a side view of two varieties of possible office modular storage and work surface components in the opened position.
Figure 5:
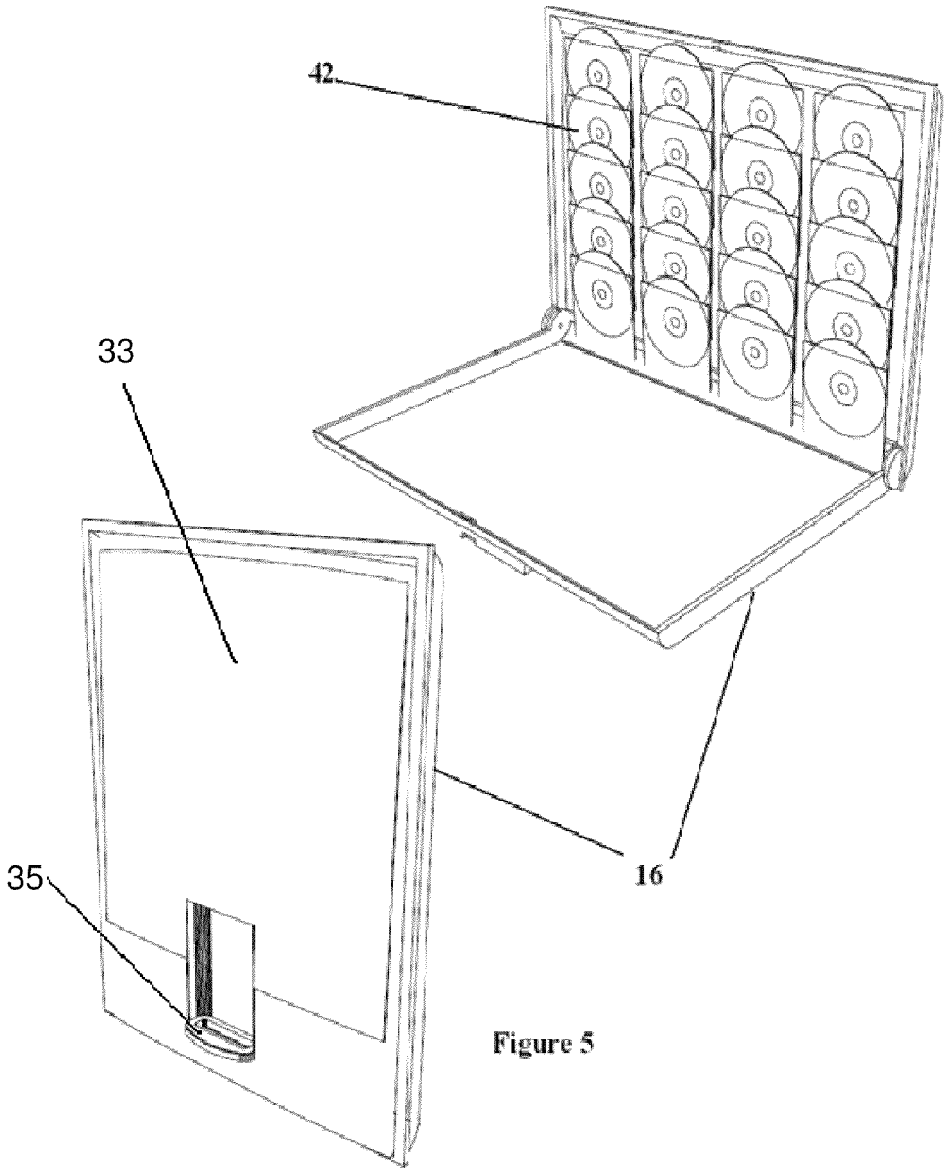
FIG. 5 is a side view of a modular component in an both open and closed position.
Figure 6:
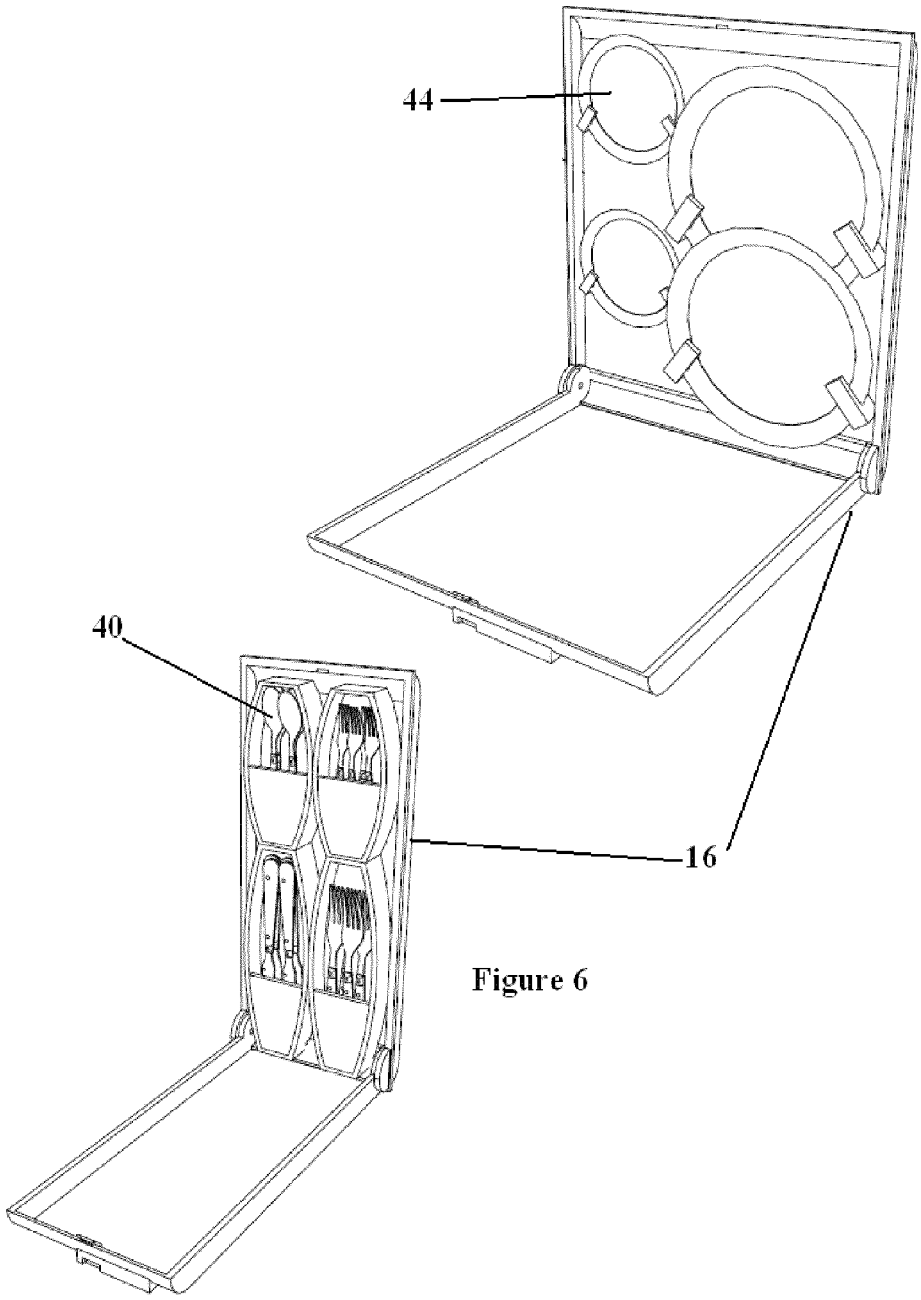
FIG. 6 is a side view of two possible varieties of kitchen modular storage components.

Referring now generally to the Figures and particularly to FIG. 4, FIG. 5, and FIG. 6, FIG. 4 is a side view of two varieties of possible office modular storage and work surface components 16, FIG. 5 is a side view of two varieties of possible modular entertainment components, such as CD storage in an open position and a speaker 33 and MP3 player dock 35, and FIG. 6 is a side view of two possible varieties of kitchen modular storage components 16. The modular components 16 can easy adapt to fold open to a desk 36 and in an electrified panel 3E could be used to support a flat panel computer screen 30, lights 32, a speaker 33 connected to an music player dock 35 or optionally any other electrified item 34 that would fit inside the modular components 16. Quite alternatively these components could be used to store various supplies 38, utensils 40, non-electrical components 42 or optionally various non-electrical items 44 that could reside within the collapsed space of the modular component 16.

Figure 17:
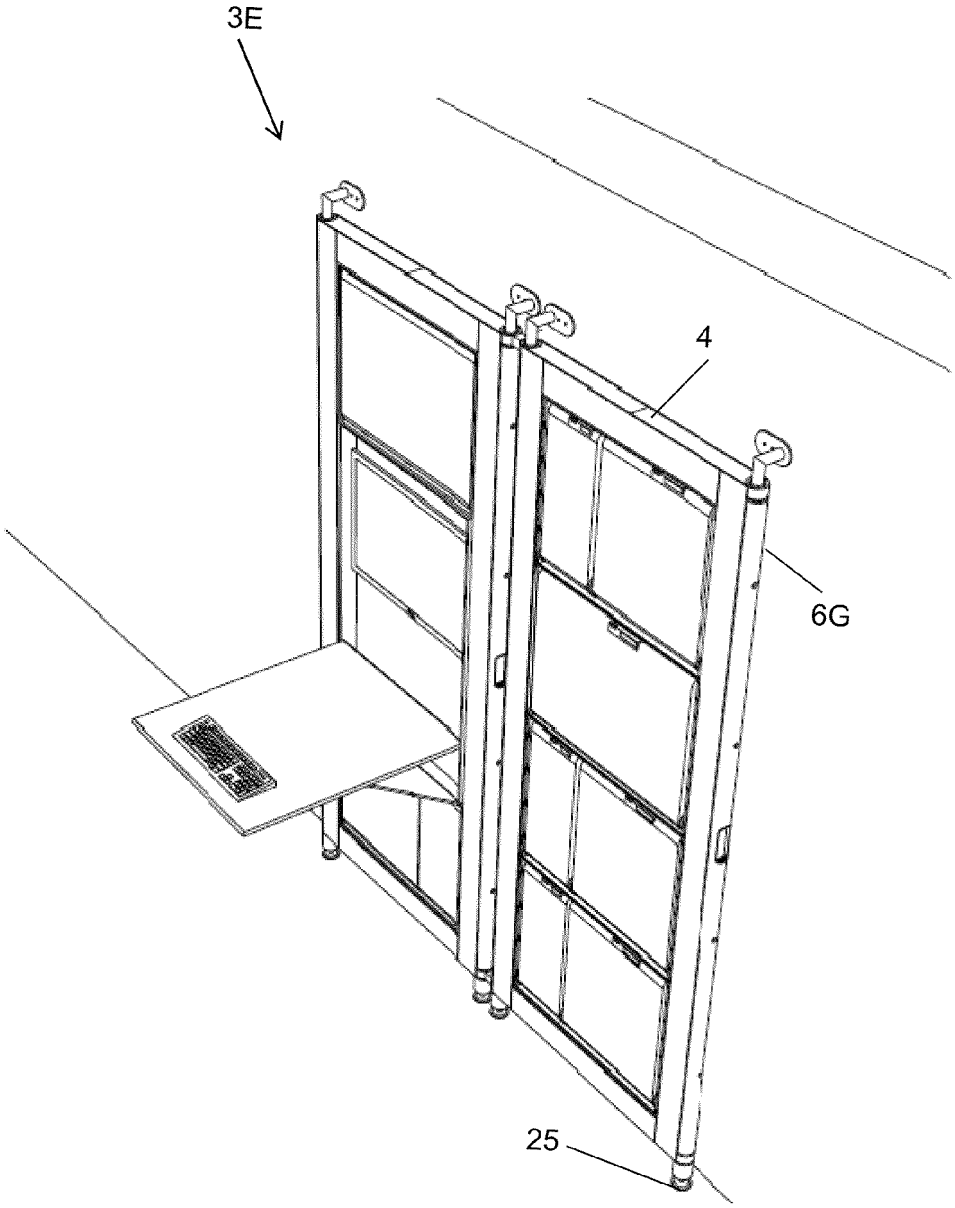
FIG. 17 is a side view of a fixed wall mount end rail attachment at use.

Referring now generally to the Figures and particularly to FIG. 17, FIG. 17 is a side view of a fixed wall mount end rail attachment 6G at use. Use of the fixed wall mount end rail 6G in conjunction with the panel frame 4 is a fifth configuration 3E of the invented panel 3. This configuration 3E consists of two rails 6G bolted to a wall in addition with a floor support 25 to stabilize the panel.

Figure 18:
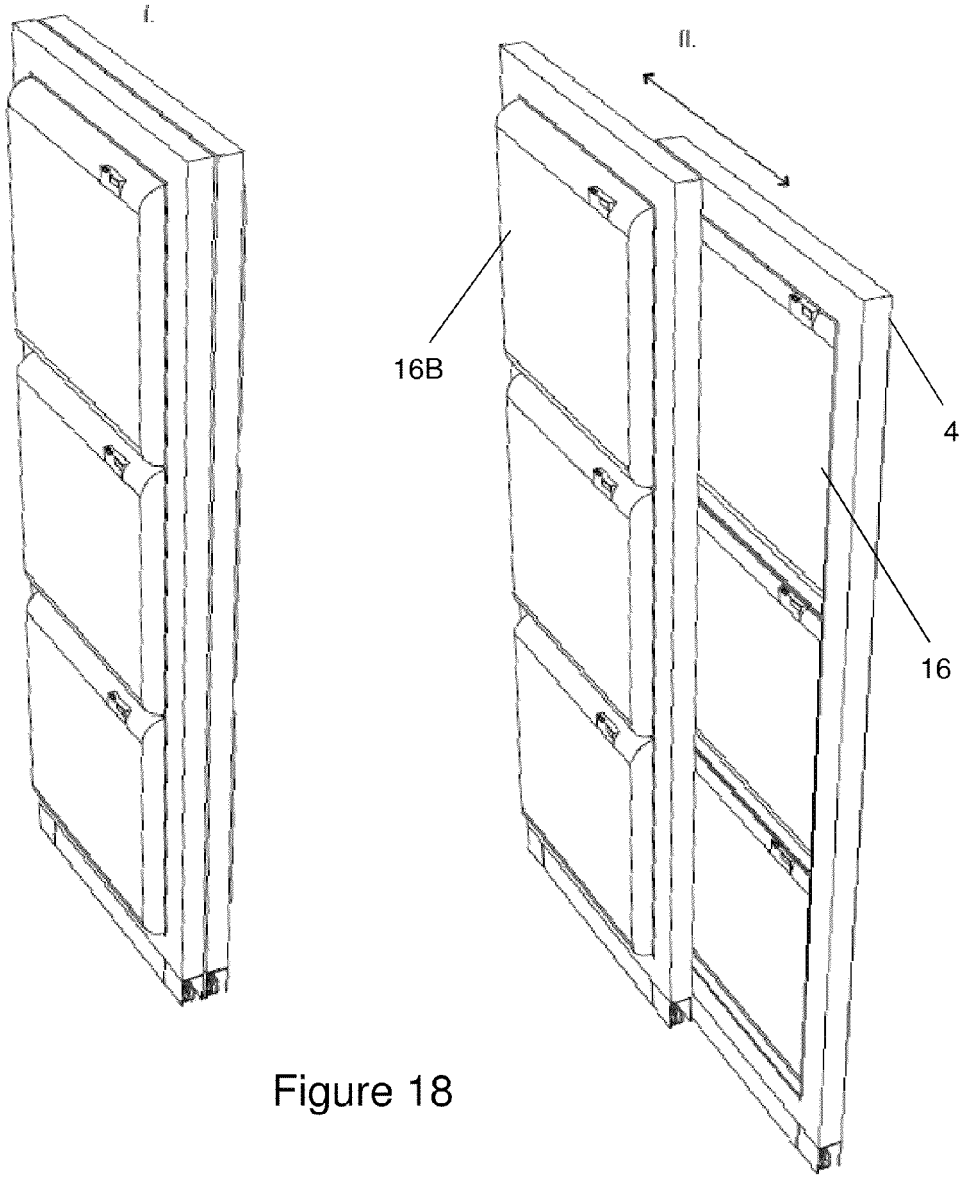
FIG. 18 is the invented panel in a sliding door configuration with single side non-flush modular elements.

Referring now generally to the Figures and particularly to FIG. 18, FIG. 18 is the invented panel in a sliding door configuration 3B using single side non-flush modular elements 16A. Single side non-flush modular elements 16A can be used in any of the invented panel configurations 3A-E, but are shown here in a sliding door configuration 3B. By using single side non-flush modular elements 16A there is more space to use for any function that the customizable panel 3 is to be used for. In the sliding door configuration 3B and in other multi panel configurations, only the outer panel used may use a single sided non-flush modular element 16A otherwise the panels 3 would not be fully mobile.

Figure 19:
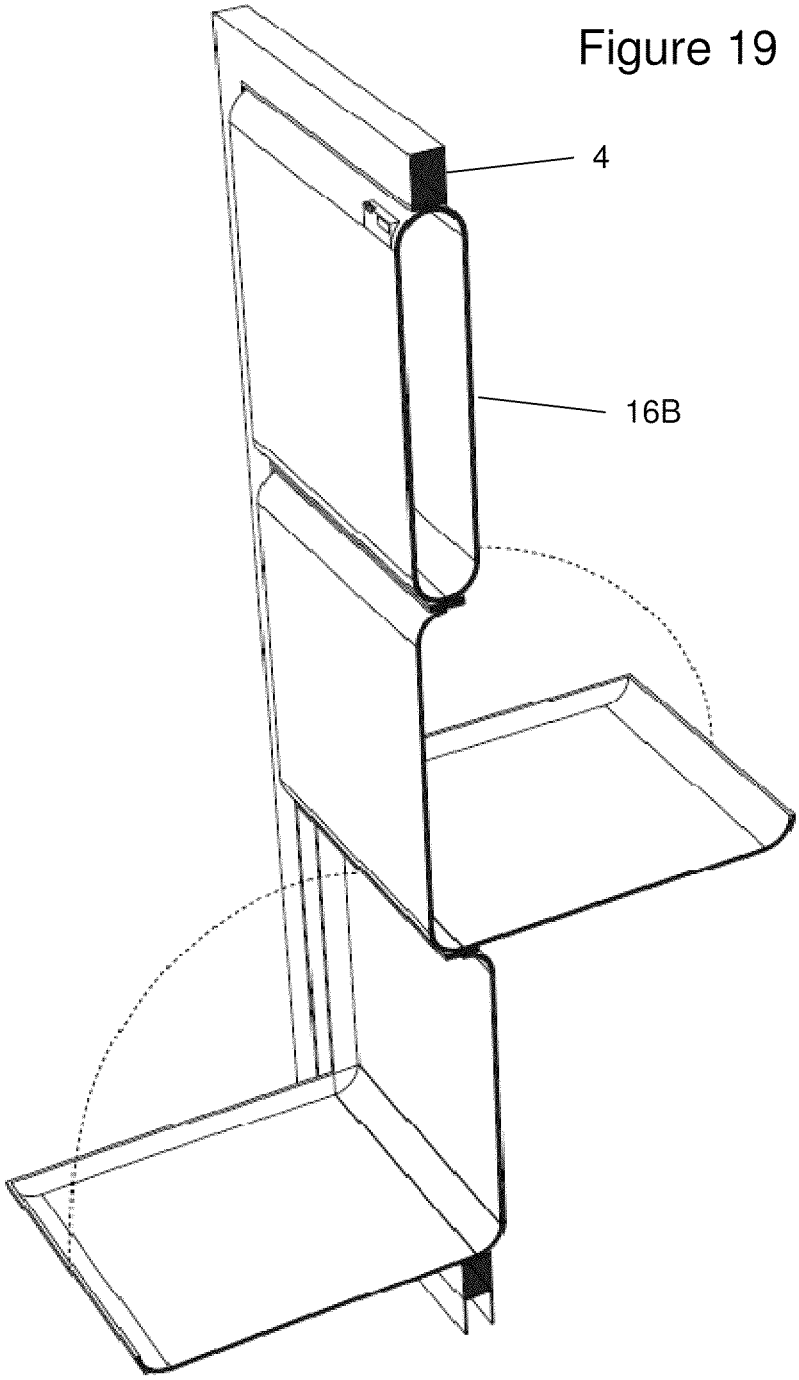
FIG. 19 is the invented panel with use of double sided non-flush modular elements opening to both sides of the panel.

Referring now generally to the Figures and particularly to FIG. 19, FIG. 19 is the invented panel 3 with use of double sided non-flush modular elements 16B. Use of the non-flush modular elements 16B can only be accomplished in configurations wherein the invented panel 3 does not have to meet with another surface flush. The purpose of the non-flush modular elements 16B is simply to provide more space. FIG. 19 also shows that the modular elements can be accessed from either the front face or the rear face of the panel, depending on how the modular elements were initially installed.

Figure 20:
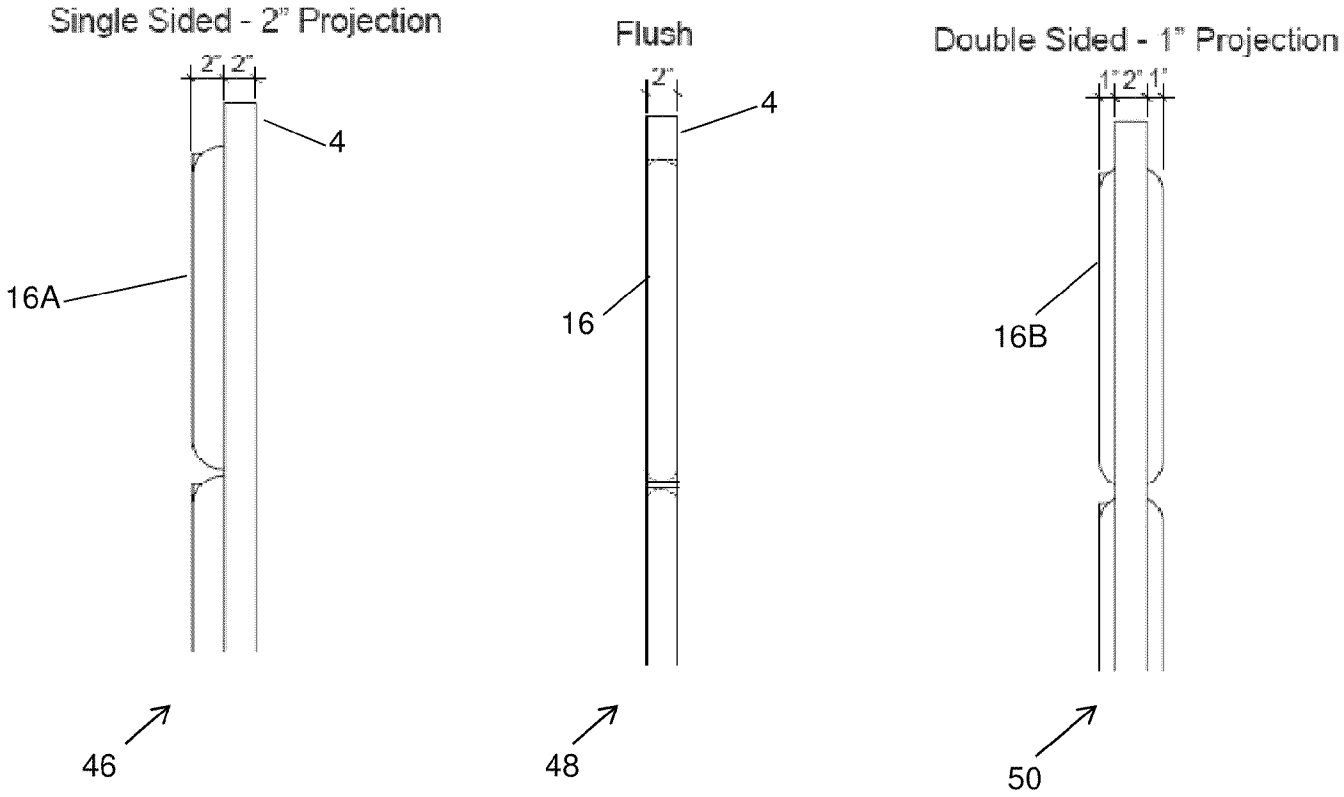
FIG. 20 a cut away diagram as it relates to the storage depth of modular elements in a single side non-flush condition, a flush condition, and a double sided non-flush condition.

Referring now generally to the Figures and particularly to FIG. 20, FIG. 20 a cut away diagram of various panel widths in different configurations 46-50. A suggested width for a single sided non-flush modular element 16A would be roughly two inches beyond the width of the door, though other sizes could be used in this particular configuration 46. As shown by configuration 48, when flush modular elements 16 are used, the panel 3 is no wider than the width of the frame 4. A double sided non-flush modular element 16B as used in configuration 50 could be the same width as the single sided non-flush modular element 16A but instead of bulging out entirely on one side the width is shared equally on either side of the frame 4.

Figure 21:
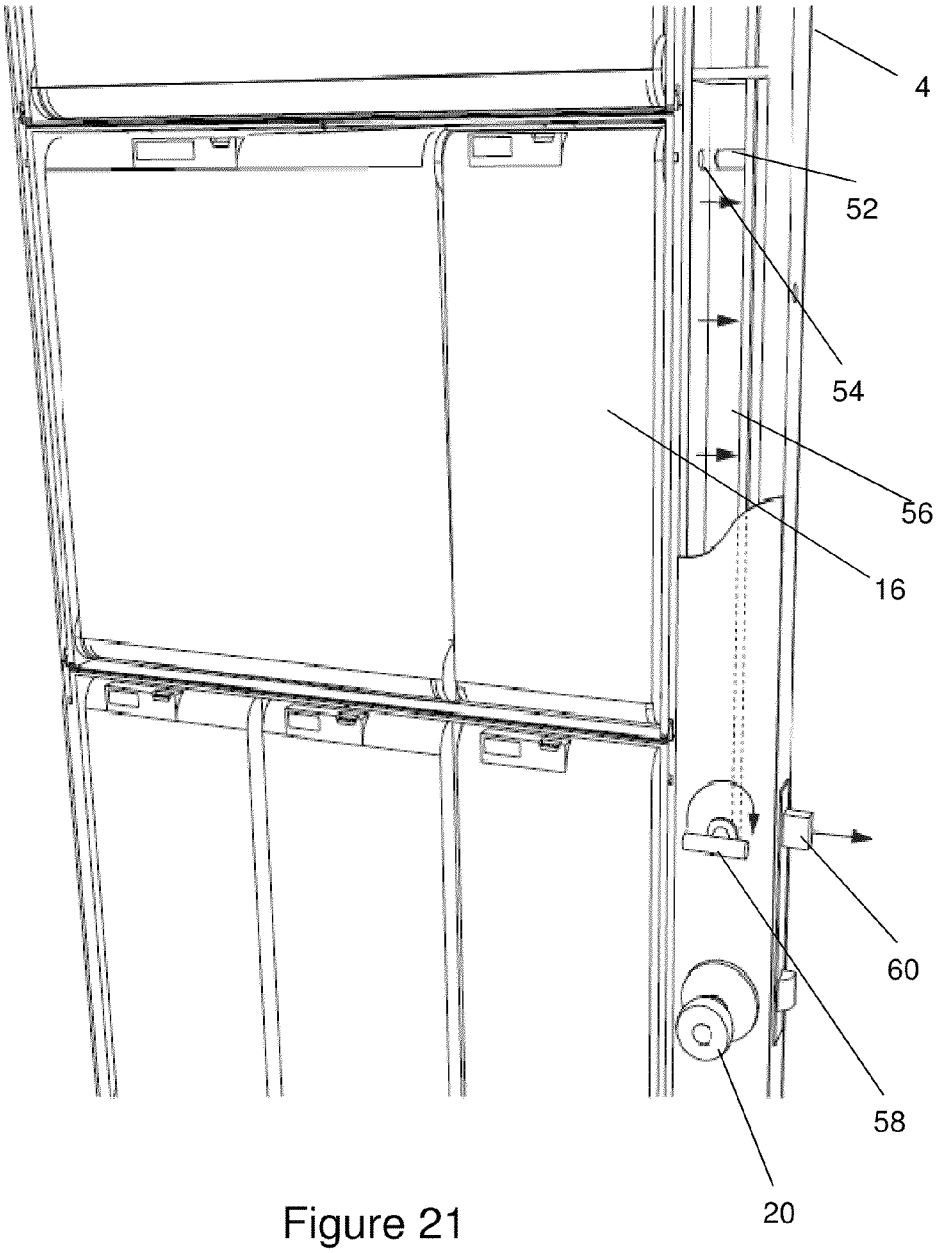
FIG. 21 is a cut away view of an in-use locking mechanism for the invented panel.

Referring now generally to the Figures and particularly to FIG. 21, FIG. 21 is a cut away view of an in use locking mechanism for the invented panel 3. In order to keep the present invention safe for a user it may become necessary when in use to lock the panel 3 closed in order to operate modular elements 16. One method of accomplishing this is by sticking the first end of a pin 52 through a modular element hole 54 preventing the modular element 16 from being opened and affixing a second end of a pin 52 to a flange 56 that may be toggled to either remove the pin 52 from the modular element hole 54, or replace the pin 52 back in the hole 54 preventing the opening of the modular element 16. The flange 56 could be attached to a deadbolt toggle 58, which when the deadbolt toggle 58 engages a deadbolt 60, the toggle 58 additionally alters the position of the flange 56 such that the flange 56 removes the pin 52 from the modular element hole 54 thus allowing the modular element 16 to be opened while locking the panel 3. Additionally more than a single pin 52 could be used such that additional pins 52 would fit into corresponding modular element holes 54 of secondary, tertiary and so forth modular elements 16 past a first. Other methods and apparatus could be used in order to accomplish this same effect. An additional example not pictured would involve causing the opening of a modular element 16 to force a deadbolt 60 to be engaged as opposed to the pictured example in which the deadbolt 60 must be engaged first in order to open a modular element 16.

Figure 22:
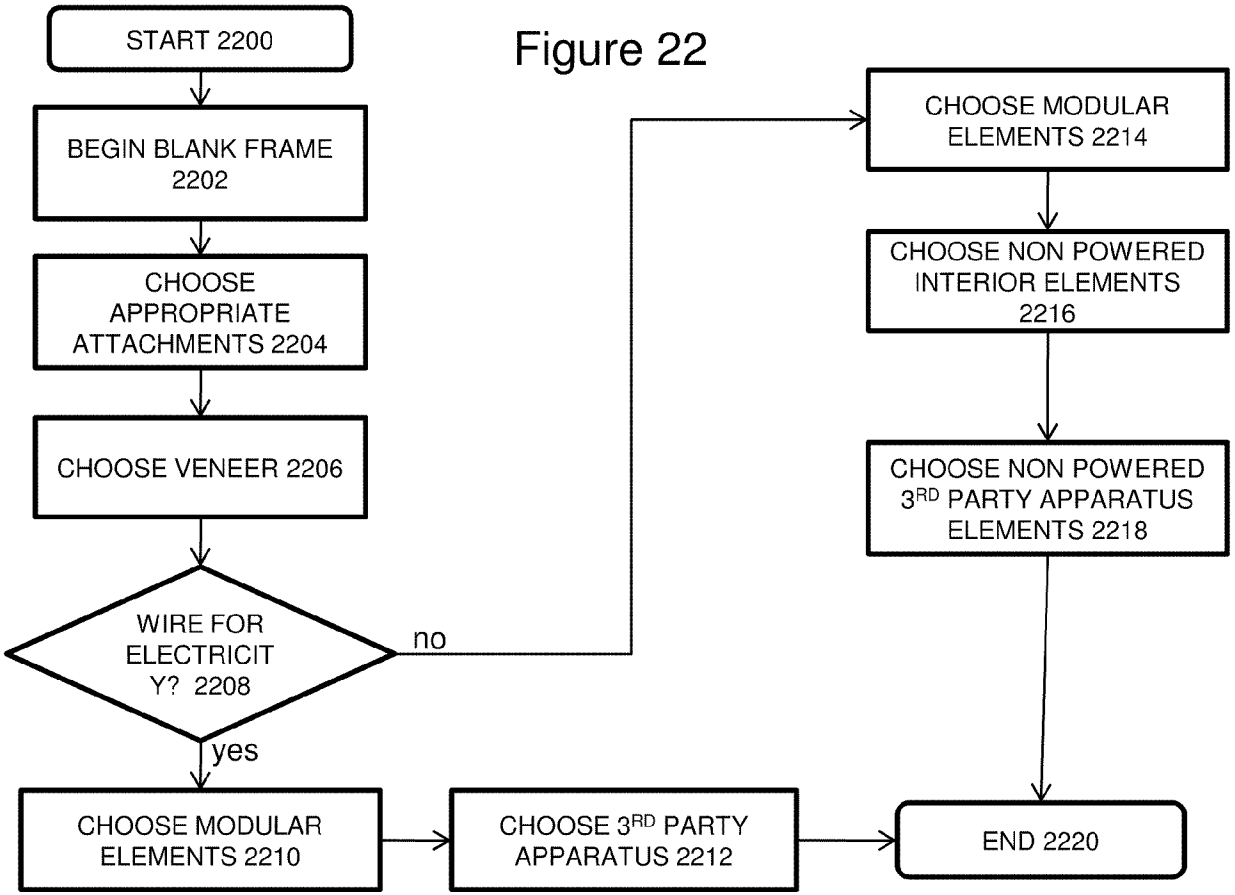
FIG. 22 is a flow chart of a preferred method of marketing the invented panel.

Referring now generally to the Figures and particularly to FIG. 22, FIG. 22 is a flow chart of a preferred method of marketing the invented panel. A preferred way to market the invented panel 3 would begin by allowing a customer to first select a frame 4, potentially choose use of spacers 12 to select the frame's 4 size (2202). Then a customer would decide what sort of use the panel 3 would be put into by choosing relevant attachments 6A-G, 10A-C to cast the panel's 3 role (2204). A customer would then choose a veneer or skin 18 to coat the customized panel 3 (2206). In step 2208 a customer decides if the panel 3 should be configured for electricity. If a customer determines that the panel 3 should be configured for electricity, they would then determine the electrified modular element 16, or elements 16 desired in the electrified panel 3E (2210). Then the customer would choose powered and non powered items to be placed within the elements 16, many of these could be created by a third party company (2212).

Alternatively, if the panel were chosen to not be electrified, much like step 2210, a customer would determine the modular element(s) 16 to be placed within the frame 4 of their panel 3 (2214). In the following step 2216, a customer would decide items to be placed within the chosen modular element(s) 16 such as storage elements as shown in FIGS. 5 and 6 or table elements 36. Additionally it is conceivable that non electrified 3rd party items could be developed for modular elements 16 and customers could pick those out in a following step (2218). The important aspects to take away from this method are that a customer starts with a base product and then can have a whole shopping experience involved in customizing a panel 3 specifically for that customer.

The foregoing disclosures and statements are illustrative only of the Present Invention, and are not intended to limit or define the scope of the Present Invention. The above description is intended to be illustrative, and not restrictive. Although the examples given include many specificities, they are intended as illustrative of only certain possible examples of the Present Invention. The examples given should only be interpreted as illustrations of some of the examples of the Present Invention, and the full scope of the Present Invention should be determined by the appended claims and their legal equivalents. Those skilled in the art will appreciate that various adaptations and modifications of the just-described examples can be configured without departing from the scope and spirit of the Present Invention. Therefore, it is to be understood that the Present Invention may be practiced other than as specifically described herein. The scope of the present invention as disclosed and claimed should, therefore, be determined with reference to the knowledge of one skilled in the art and in light of the disclosures presented above.

What is claimed is:

1. A modular panel comprising: a rectangular frame, the rectangular frame further includes a door handle and one or more bracket, the brackets enabling the modular panel to affix to an external structure; and at least one modular element, the at least one modular element adjustably secured inside the rectangular frame and the modular element having walls creating an internal hollow volume, the internal hollow volume of the modular element configured to enclose one or more additional objects on all sides.

2. The modular panel of claim 1 wherein the modular panel conforms to the size of a commonly used interior American or international door panel.

3. The modular panel of claim 1, including at least a first modular panel, and a second modular panel; each the first modular panel and the second modular panel further comprising one or more said brackets affixed to the rectangular frame of each, said brackets enabling the rectangular frame to rotatably affix to either an external structure or an adjacent modular panel, wherein a first modular panel rotatably affixes by means of said brackets to the second modular panel, and any subsequent modular panels rotatably affix to the second modular panel and thereon such that affixed panels are configured to function as a folding door.

4. The modular panel of claim 1 including a first modular panel, and a second modular panel wherein each said modular panel affixes by means of the one or more brackets to an external structure, the external structure being a door frame, wherein the first modular panel and the second modular panel are affixed to either side of said door frame configured to function as a double door.

5. The modular panel of claim 1, including at least a first modular panel, and a second modular panel; each modular panel further comprising one or more wheel brackets affixed to the rectangular frame, the wheel brackets enabling the rectangular frame to be received by an external structure that has a track, the external structure being a sliding door frame; wherein, the at least first modular panel and second modular panel are received by said sliding door frame configured to form a sliding door.

6. The modular panel of claim 1 wherein a modular element or combination of modular elements encloses a fold out desk or table.

7. The modular panel of claim 1 wherein a modular element or combination of modular elements encloses a fold out cutting board.

8. The modular panel of claim 1 wherein at least one modular element is removable.

9. The modular panel of claim 1 wherein the door handle contains a means for forcing the locking of the door handle into an external structure while at least one modular element is accessed.

10. The modular panel of claim 1 wherein the frame is sheathed in an interchangeable skin selected from a group consisting of wood veneer; metal panels; plastic panels; glass; and flame retardant materials.

11. A modular panel comprising: a rectangular frame, at least one modular element, the at least one modular element adjustably secured inside the rectangular frame and the modular element having walls creating an internal hollow volume, the internal hollow volume of the modular element configured to enclose one or more additional objects on all sides, wherein the modular panel is connected to a source of electrical power and at least one modular element is configured to receive a power operate device.

12. The modular panel of claim 11 wherein a modular element or combination of modular elements enclose one or more devices selected from a group consisting of a flat panel television; speakers; a portable music player dock; a useable desktop computer; a light source; a fax machine; a copier; and a printer.

13. The modular panel of claim 11 with a front surface and a rear surface wherein the at least one modular element is accessible from either the front surface of the modular panel or the rear surface of the modular panel.

14. The modular panel of claim 11 wherein the modular panel further comprises spacers, the spacers insertable into the rectangular frame such that the dimensions of the modular panel are increased.

15. A method of customizing a modular panel which begins with a panel frame for the modular panel and then includes the following steps:

a. affixing to the panel frame at least one mounting attachment and a door handle;

b. affixing to the panel frame a veneer sheath;

c. affixing to the panel frame at least one modular element, the at least one modular element having walls creating an internal hollow volume, the internal hollow volume of the modular element to enclose additional objects; and choosing objects to place inside the modular elements.

* * * * *